US012140150B2

(12) United States Patent
Seok

(10) Patent No.: US 12,140,150 B2
(45) Date of Patent: Nov. 12, 2024

(54) FLUID PUMP IMPELLER

(71) Applicant: TBK Co., Ltd., Tokyo (JP)

(72) Inventor: Jea woong Seok, Tokyo (JP)

(73) Assignee: TBK Co., Ltd., Tokyo (JP)

( * ) Notice: Subject to any disclaimer, the term of this patent is extended or adjusted under 35 U.S.C. 154(b) by 0 days.

(21) Appl. No.: 18/579,044

(22) PCT Filed: Jul. 16, 2021

(86) PCT No.: PCT/JP2021/026723
§ 371 (c)(1),
(2) Date: Jan. 12, 2024

(87) PCT Pub. No.: WO2023/286263
PCT Pub. Date: Jan. 19, 2023

(65) Prior Publication Data

US 2024/0287997 A1 Aug. 29, 2024

(51) Int. Cl.
*F04D 1/00* (2006.01)
*F04D 29/041* (2006.01)
(Continued)

(52) U.S. Cl.
CPC ..... *F04D 29/2216* (2013.01); *F04D 1/00* (2013.01); *F04D 29/041* (2013.01); *F04D 29/628* (2013.01); *F04D 29/669* (2013.01)

(58) Field of Classification Search
CPC ..... F04D 1/00; F04D 29/2216; F04D 29/041; F04D 29/669; F04D 29/628; F04D 29/2266
See application file for complete search history.

(56) References Cited

U.S. PATENT DOCUMENTS 5,224,821 A * 7/1993 Ozawa ..... F04D 29/2222 416/223 R
7,326,029 B2 * 2/2008 Ahlroth ..... F04D 29/2266 415/106

(Continued)

FOREIGN PATENT DOCUMENTS

GB 2390398 A * 1/2004 ..... F04D 29/126
WO 2016/030928 A1 3/2016

OTHER PUBLICATIONS

International Preliminary Report on Patentability (Chapter I) and Written Opinion of the International Searching Authority issued in PCT/JP2021/026723; issued Jan. 16, 2024.

(Continued)

*Primary Examiner* — Eldon T Brockman
(74) *Attorney, Agent, or Firm* — Studebaker & Brackett PC

(57) ABSTRACT

An impeller (1) of a fluid pump according to the present invention comprises: an impeller body (10) having a first shroud (20) and a plurality of vanes (30) provided on the first shroud (20); and a second shroud (50) bonded to the impeller body (10) and arranged opposed to the first shroud (20) in a central axis direction across the plurality of vanes (30). The first shroud (20) has a boss part (40) protruding in the central axis direction. The second shroud (50) has a central hole (53) through which the boss part (40) is inserted in the central axis direction. By a combination of a recessed first groove part (41) formed on an outer circumferential surface of the boss part (40) and a recessed second groove part (54) formed on an inner circumferential surface of the central hole (53), a balance hole (B) penetrating in the central axis direction is constituted.

5 Claims, 12 Drawing Sheets

(51) Int. Cl.

| | |
|---|---|
| ***F04D 29/22*** | (2006.01) |
| ***F04D 29/62*** | (2006.01) |
| ***F04D 29/66*** | (2006.01) |

(56) References Cited

U.S. PATENT DOCUMENTS

| | | | | |
|---|---|---|---|---|
| 2017/0218970 | A1* | 8/2017 | Ahlroth | F04D 29/106 |
| 2017/0268526 | A1* | 9/2017 | Seok | F04D 29/242 |

OTHER PUBLICATIONS

International Search Report issued in PCT/JP2021/026723; mailed Aug. 31, 2021.

* cited by examiner

FLUID PUMP IMPELLER

TECHNICAL FIELD

The present invention relates to an impeller used in a fluid pump, for example, a water pump or the like.

TECHNICAL BACKGROUND

Conventionally, there are widely known centrifugal fluid pumps that pressurize fluid sucked through an inlet and deliver it through an outlet by rotating an impeller formed with a plurality of blades in a pump casing. As the impeller, in addition to an open impeller in which a shroud is provided only on one ends of the blades, there is a closed impeller in which shrouds are provided on opposite ends of the blades so as to hold the blades from opposite sides (for example, see Patent Document 1). The closed impeller can be said to have a higher pump efficiency than the open impeller since both the shrouds form a space closed within the impeller, thereby preventing a leaking fluid flow.

This closed impeller (also referred to below simply as an impeller) includes an upper shroud, a lower shroud, and a plurality of blades provided between both the shrouds. Here, in a pump casing in which this impeller is disposed, generally, the pressure becomes higher below the impeller than above the impeller, so that an axial load (a thrust load) acts on the impeller. Therefore, the lower shroud is provided with an axially penetrating circular balance hole, and the fluid is allowed to escape from a high pressure side (a rear face side of the lower shroud) to a low pressure side (a front face side of the lower shroud) through this balance hole to reduce an axial pressure difference (the thrust load) that occurs between the front and rear faces of the lower shroud, so that an event where the impeller floats up and interferes with an inner circumferential surface of the pump casing is prevented.

PRIOR ARTS LIST

Patent Document

Patent Document 1: International patent Publication No. 2016/030928 A1

SUMMARY OF THE INVENTION

Problems to be Solved by the Invention

The closed impeller, however, structurally takes a shape in which the blades are joined to the upper and lower shrouds (disks) on the opposite ends, and therefore, when, for example, it is integrally molded as an injection-molded product, a so-called undercut is created when it is demolded, and the undercut can be a factor that hinders mass production. Therefore, there has been recently implemented a technique of forming a closed impeller by molding an upper shroud and a lower shroud separately and joining both the shrouds via a plurality of blades.

Here, when the lower shroud is injection-molded, a core pin for forming a circular balance hole (a through-hole) is arranged in a cavity. Molten resin flowing in the cavity splits into two flows around the core pin, and the two flows join after coming around behind the core pin, but, at the junction, a weld line, which is left as a seam by the two flows (molten resin flows) failing to fuse together, is likely to occur. Consequently, there is a problem where a crack starting from this weld line may occur during the operation of the impeller, and this crack may eventually grow into a large one and cause a fracture of the impeller.

The present invention has been made in view of such a problem, and an object thereof is to provide a fluid pump impeller capable of preventing a fracture starting from a weld line that occurs during injection molding.

Means to Solve the Problems

In order to solve the above problem, a fluid pump impeller according to the present invention is a fluid pump impeller rotationally driven around a center axis, comprising an impeller main body comprising a first shroud and a plurality of blades provided to the first shroud, and a second shroud joined to the impeller main body and so arranged as to face the first shroud in a direction of the center axis with the plurality of blades held therebetween, wherein the OKfirst shroud has a boss so formed as to protrude in the direction of the center axis, the second shroud has a center hole into which the boss is inserted in the direction of the center axis, and a recess-like first groove formed in an outer circumferential surface of the boss and a recess-like second groove formed in an inner circumferential surface in the center hole are combined, thereby configuring a balance hole penetrating in the direction of the center axis.

In addition, in the fluid pump impeller according to the present invention, it is preferred that the blades are so formed as to be integrally continuous with an outer circumferential side of the boss, and the first groove is formed between the blades adjacent to each other on the outer circumferential surface of the boss.

In addition, in the fluid pump impeller according to the present invention, it is preferred that the first groove having a semicircular shape in cross-section and the second groove having a semicircular shape in cross-section are combined, thereby configuring the balance hole having a circular shape in cross-section.

In addition, in the fluid pump impeller according to the present invention, it is preferred that the boss is coupled with a drive shaft for rotating the impeller, and the impeller main body is configured to be rotatable integrally with the drive shaft.

In addition, in the fluid pump impeller according to the present invention, it is preferred that the blade has a welding abutting portion at a distal end facing the second shroud in the direction of the center axis, the second shroud has an elongated groove receiving the distal end of the blade, a welding receiving portion abutted against the welding abutting portion and joined thereto is formed on an inner face on one side of the elongated groove, and a protruding guide rib so formed as to protrude into the elongated groove and pressing the blade toward the one side is provided on an inner face on an other side of the elongated groove.

Advantageous Effects of the Invention

In the fluid pump impeller according to the present embodiment, since the balance hole has a split structure in which the first groove formed in the impeller main body and the second groove formed in the second shroud are combined, thereby configuring the balance hole, the balance hole can be formed without using a core pin during injection molding, and the possibility of occurrence of a weld line around the balance hole is also eliminated, so that it becomes possible to prevent an event where a crack staring from the weld line occurs in the impeller, resulting in a fracture of the impeller.

In addition, in the fluid pump impeller according to the present embodiment, since the boss, which is coupled with the drive shaft of the fluid pump, is integrally molded into the impeller main body, even if there occurs an accidental event where the impeller main body (the blades) and the second shroud are disjoined and divided during the operation of the impeller, the impeller main body (the blades) can rotate integrally with the drive shaft and discharge a predetermined amount of the cooling water, so that it becomes possible to achieve a fail-safe function that prevents an event where feeding the cooling water is completely stopped.

In addition, in the fluid pump impeller according to the present embodiment, since the protruding guide rib formed in the elongated groove interferes with the blade and presses it when the welding abutting portion and the welding receiving portion are welded, the area of contact between an outer face on the other side of the blade and the inner face on the other side of the elongated groove can be reduced, so that it becomes possible to suppress the creation of flash due to their abnormal contact.

DESCRIPTION OF THE EMBODIMENTS

Figure 1:
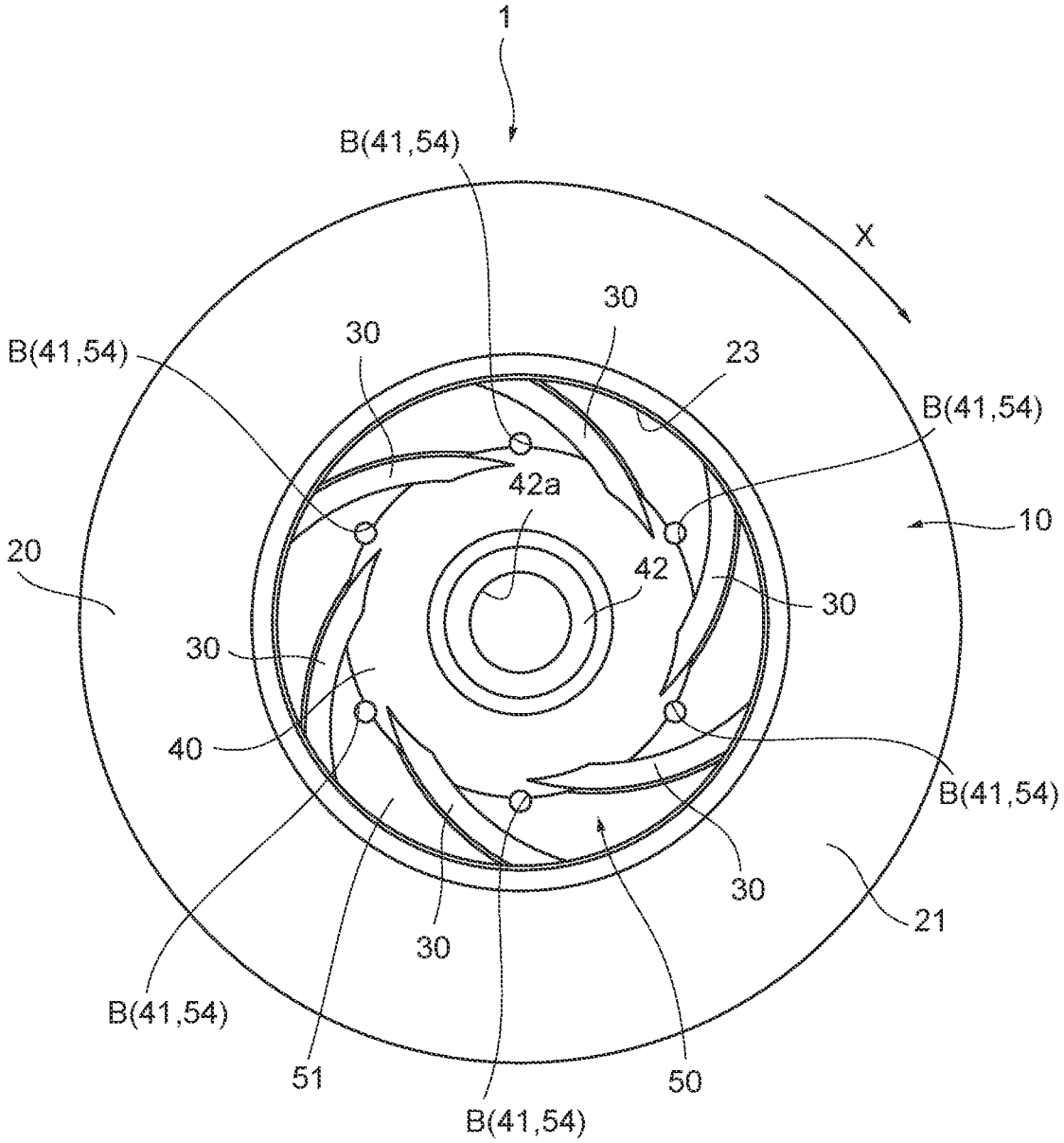
FIG. 1 is a top view showing an impeller according to the present embodiment.
Figure 2:
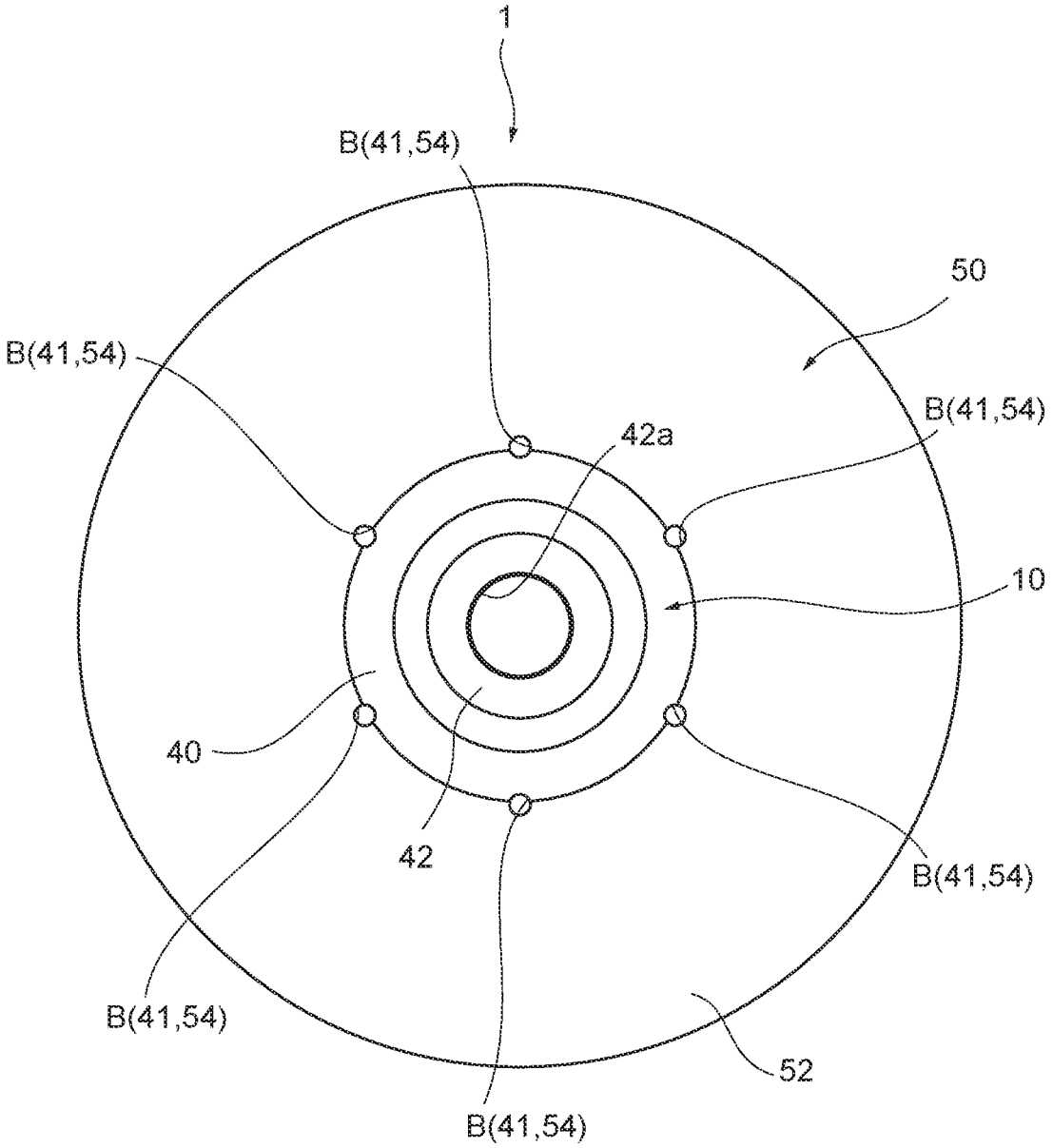
FIG. 2 is a bottom view showing the impeller.
Figure 3:
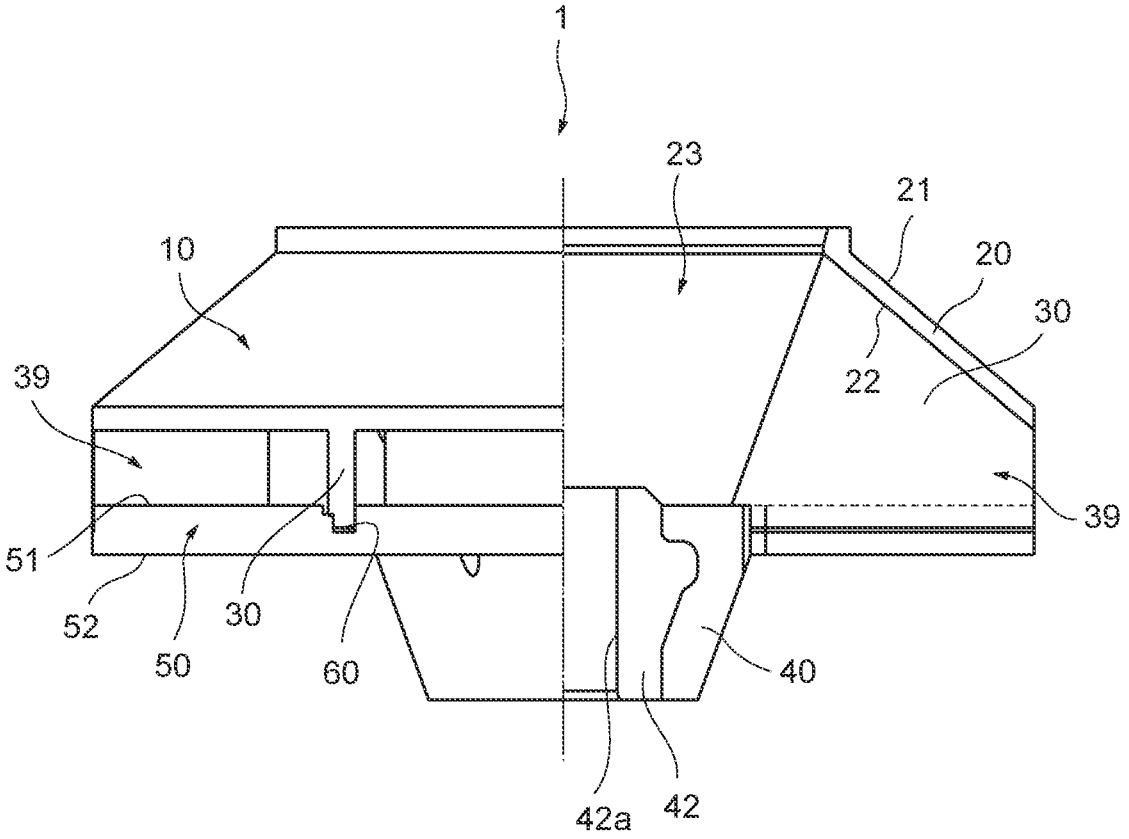
FIG. 3 is a side view (a partially cross-sectional view) showing the impeller.
Figure 4:
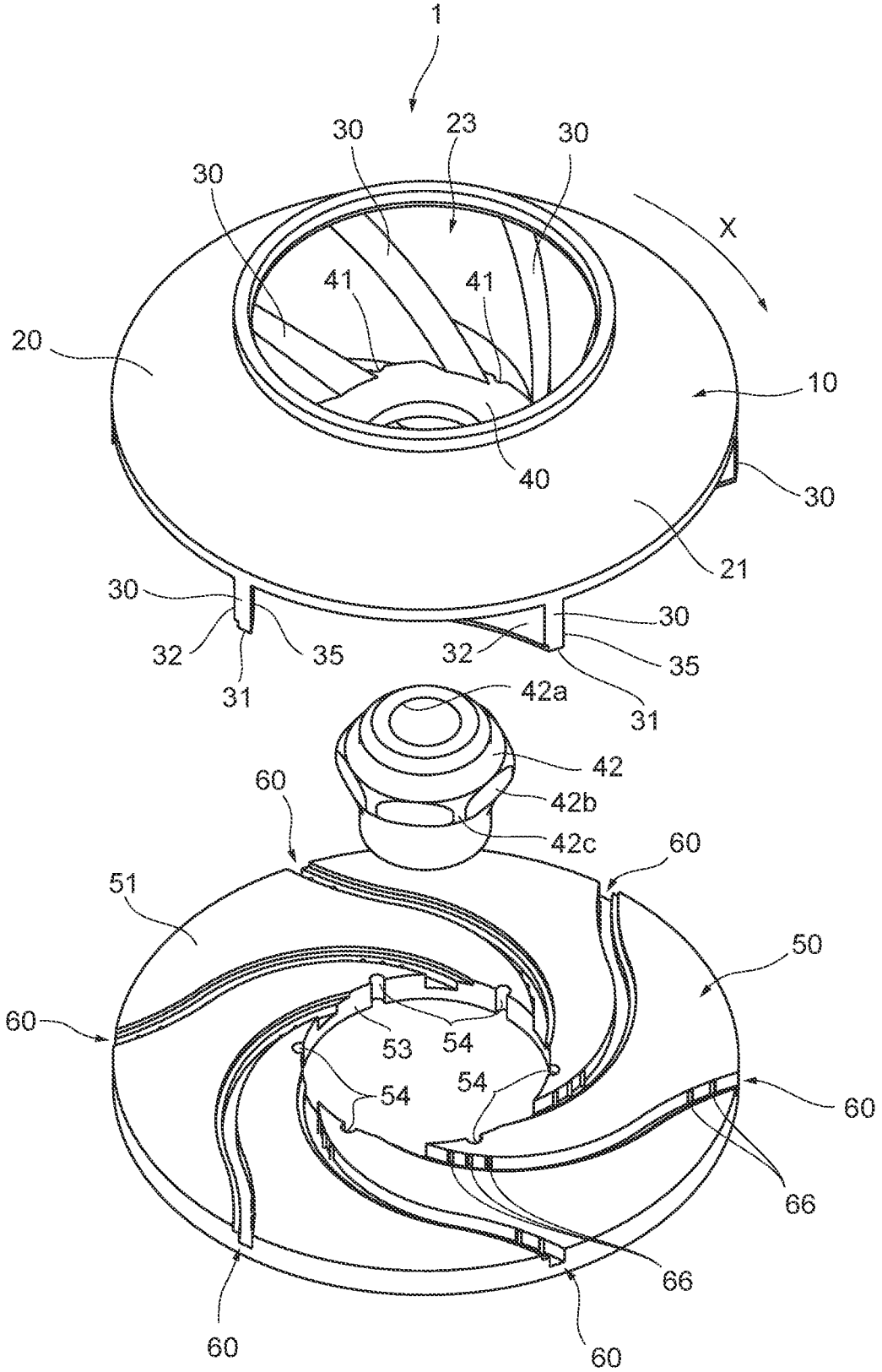
FIG. 4 is an exploded isometric view (an exploded isometric view as seen from above) of the impeller.
Figure 5:
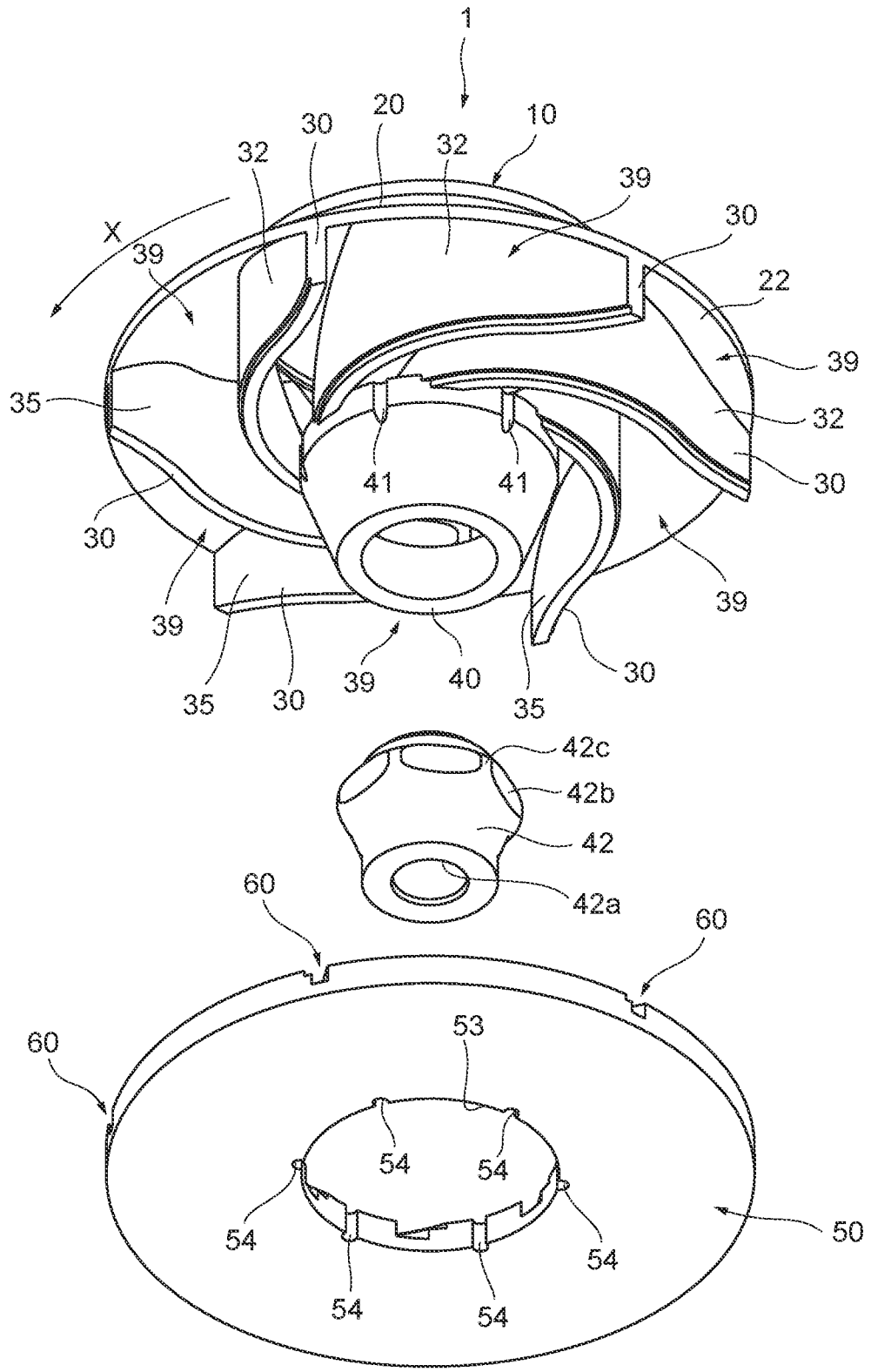
FIG. 5 is an exploded isometric view (an exploded isometric view as seen from below) of the impeller.
Figure 6:
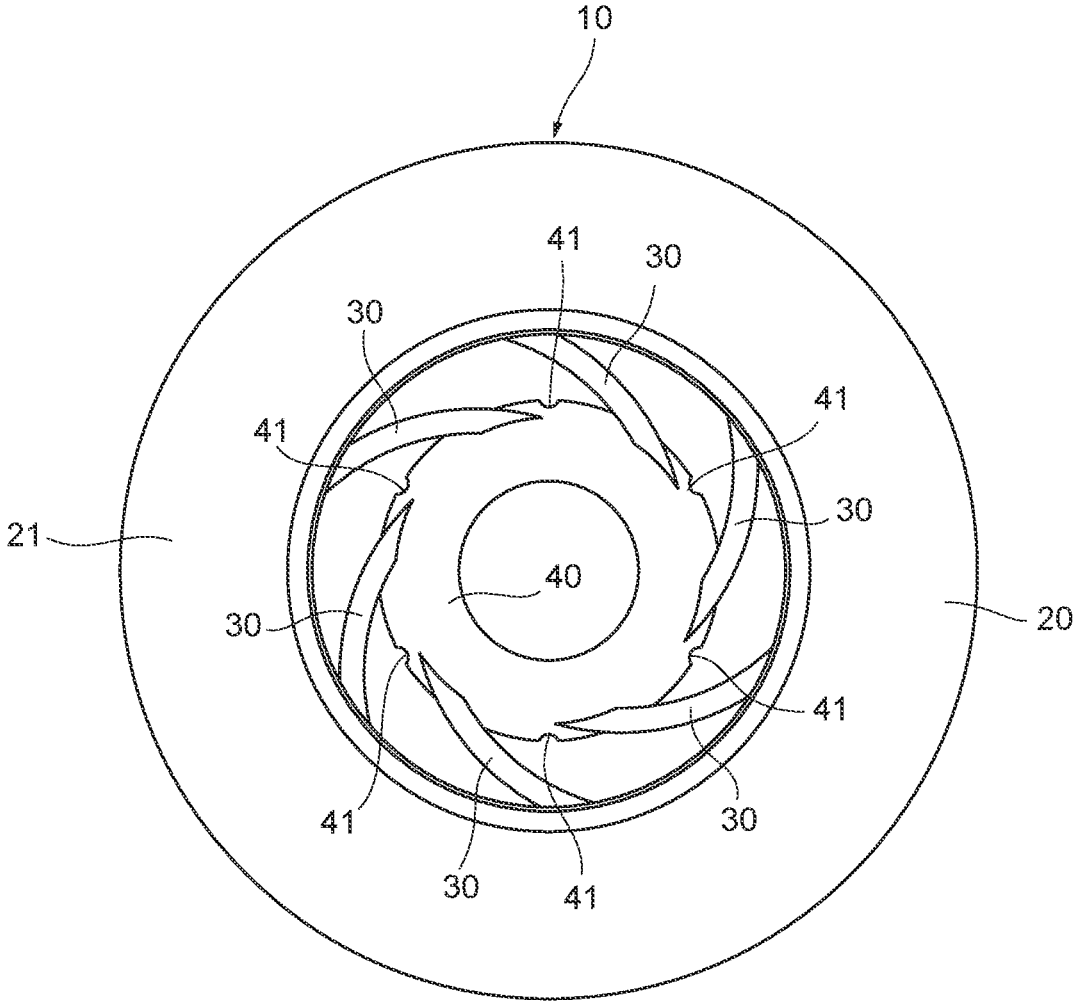
FIG. 6 is a top view showing an impeller main body (with a bush removed) of the impeller.
Figure 7:
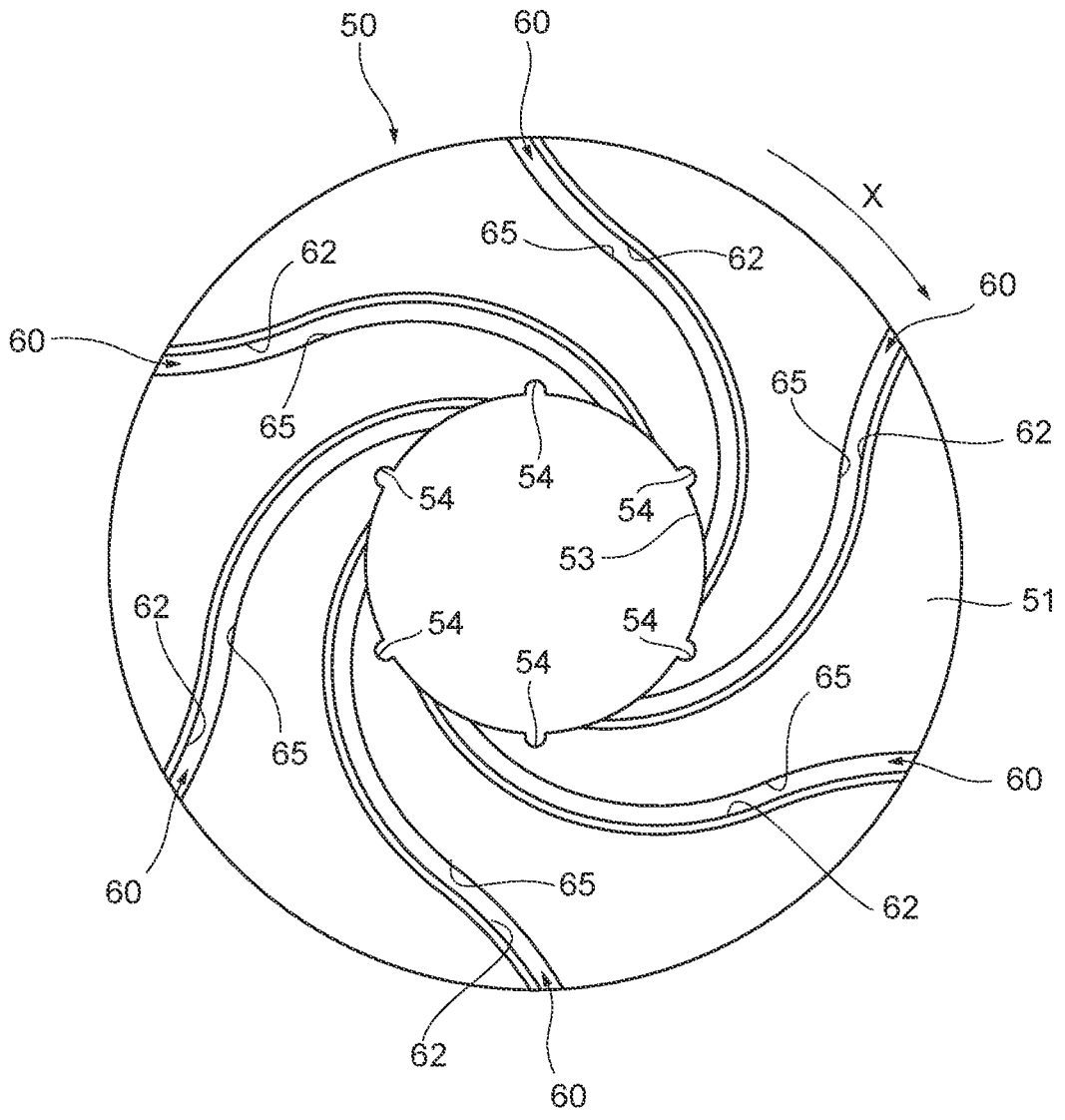
FIG. 7 is a top view showing a second shroud of the impeller.
Figure 8:
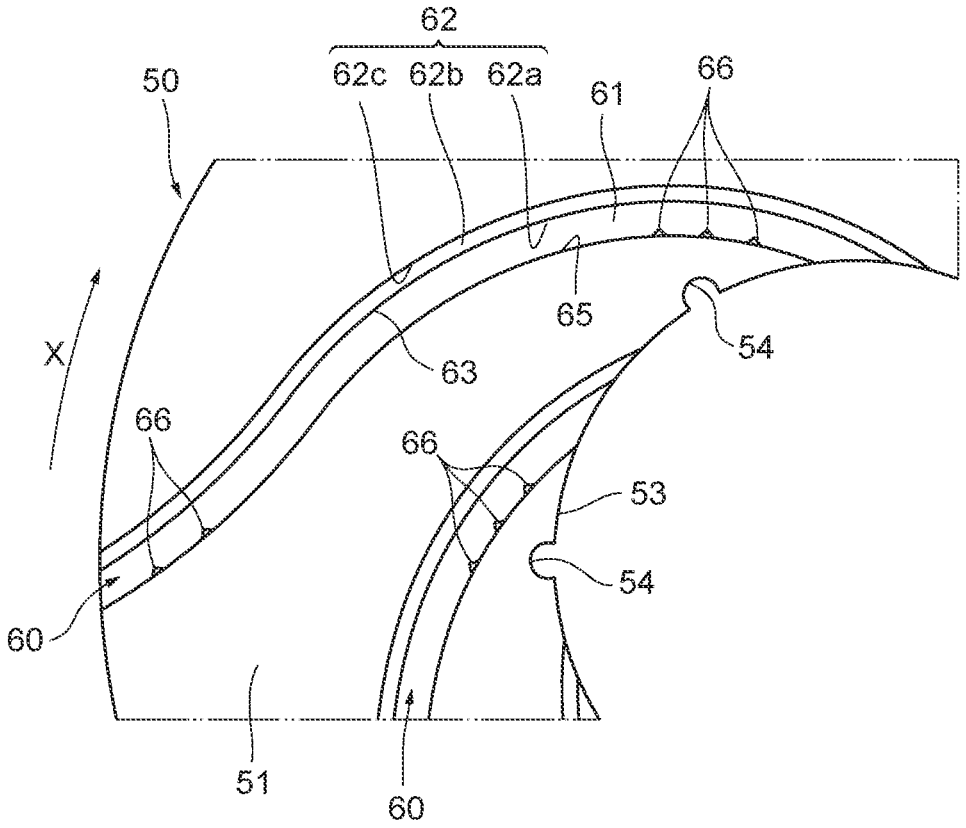
FIG. 8 is an enlarged view showing a substantial part of the second shroud.
Figure 9:
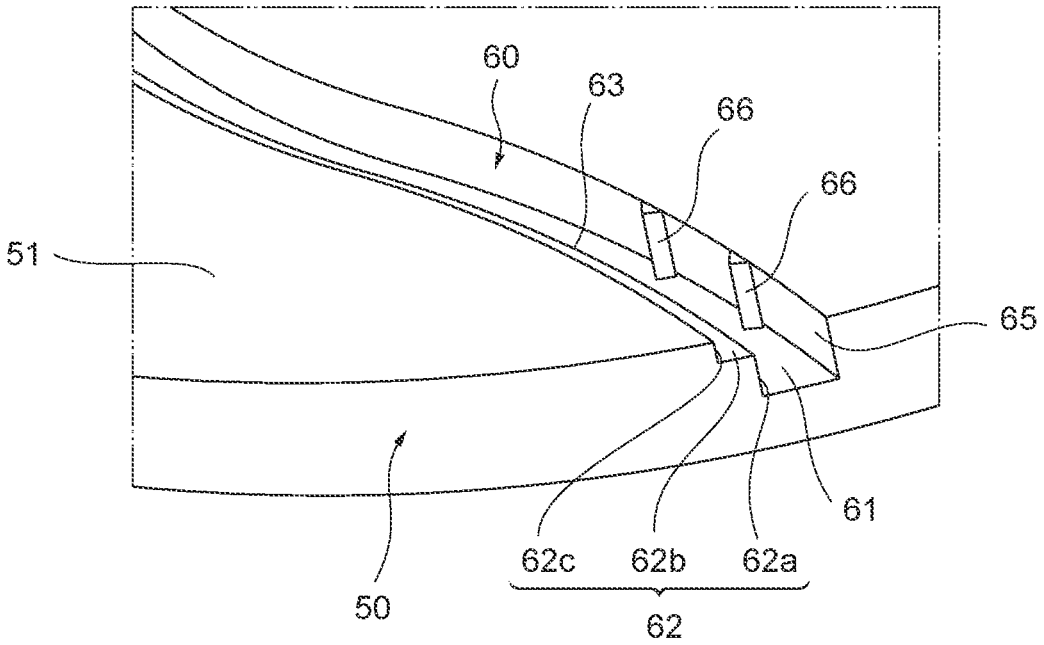
FIG. 9 is an isometric view showing the substantial part of the second shroud.

A preferred embodiment of the present invention will be described below with reference to the drawings. An impeller 1 according to an embodiment of the present invention is used in a water pump which is disposed in a cooling water circulation passage for an engine and which forcibly circulates the cooling water, for example. First, an overall configuration of the impeller 1 according to the present embodiment will be described with reference to FIGS. 1 to 12. For illustration purposes, based on the position of the impeller 1 disposed as shown in FIG. 3, an upper side in an axial direction (a direction of a center axis) is referred to as "one end side", and a lower side in the axial direction (the direction of the center axis) as "other end side". In addition, in some figures such as FIGS. 3, 11, and 12, no cross-section is hatched to clarify the drawings. In addition, a direction of rotation of the impeller 1 is denoted by an arrow "X" in some of the drawings, if needed.

The impeller 1 is a so-called closed impeller including an impeller main body 10 having a first shroud (an upper shroud) 20 integrally formed with a plurality of blades 30, and a second shroud (a lower shroud) 50 joined to this impeller main body 10. The impeller 1 rotates synchronously with a drive shaft (not shown) of the water pump, sucks the cooling water through an inlet 23 formed in the impeller main body 10, and discharges the cooling water through an outlet 39 which is a space between the blades 30.

The impeller main body 10 is formed as an integrally-molded product made of resin (preferably, a polyphenylene sulfide (PPS) resin), and includes the first shroud 20, the plurality of blades 30, and a boss 40.

The first shroud 20 is formed in the shape of a circular truncated cone (a substantially umbrella-like shape) increasing in diameter from the one end side toward the other end side in the axial direction. A front face 21 of the first shroud 20 faces an inner face of a pump casing (not shown) accommodating the impeller 1. The circular inlet (an eye) 23 for introducing the cooling water into the impeller 1 is formed through the center of the first shroud 20 in the axial direction. The plurality of blades 30 (six blades 30 in the present embodiment) are formed at equal circumferential intervals on a rear face 22 of the first shroud 20. In addition, the cylindrical boss 40 is integrally formed via the plurality of blades 30 on the rear face 22 of the first shroud 20. It should be noted that, since the first shroud 20 has a tapered shape (the substantially umbrella-like shape) in the present embodiment, the cooling water (the cooling water introduced from the inlet 23) can flow smoothly along the rear face 22 of the first shroud 20.

The blade 30 is formed in a plate-like shape curved along a center line composed of a convex curve and a concave curve which are continuously connected. The plurality of blades 30 are arranged radially around the axis, and formed in such a manner that the circumferential intervals between the blades 30 adjacent to each other increase gradually from a radial inside toward a radial outside (that is, in a direction in which the cooling water is discharged). In addition, the blades 30 are inclined in such a manner that their height gradually decreases from the radial inside toward the radial outside so as to correspond to the tapered shape of the first shroud 20. Thereby, the cross-sectional area of a radial inner (a suction-side) opening and the cross-sectional area of a radial outer (a discharge-side) opening between the adjacent blades 30 are set to be approximately equal, so that the flow rate inside can be equalized.

The blade 30 has a distal end (a blade distal end) 31 formed on the other end side of the blade 30, a front outer face (a front outer face in the direction of rotation) 32 continuous with the distal end 31 and formed on the front side in the direction of rotation, and a rear outer face (a rear outer face in the direction of rotation) 35 continuous with the distal end 31 and formed on the rear side in the direction of rotation. Further, the front outer face 32 of one of the two blades 30 adjacent to each other and the rear outer face 35 of the other blade 30 form a discharge passage (the outlet 39) for the cooling water therebetween. In addition, the distal end 31 of this blade 30 is so formed as to be capable of being received in an elongated groove 60 provided in the one end side of the second shroud 50.

The front outer face 32 includes a first outer face 32*a*, a second outer face 32*b*, and a third outer face 32*c* in order from the distal end 31 side. The first outer face 32*a* and the rear outer face 35 are each formed as a slope having an inclination of about 2 degrees in a direction toward each other from the one end side toward the other end side in the axial direction. That is, the distal end of the blade 30, as seen in cross-section, is slightly tapered from the one end side toward the other end side. A corner (a front corner in the direction of rotation) between the distal end 31 and the first outer face 32*a* of the blade 30 is configured as a portion (a welding abutting portion 33) that is welded to the second shroud 50. In addition, the second outer face 32*b* extends in a direction substantially perpendicular to the first outer face 32*a*, and serves as a lidding face (a flash outflow preventive face) 34 for preventing an outflow of flash (excess molten resin) occurring during welding.

The boss 40 is provided on the axis of the impeller main body 10, and serves as a portion that is coupled with the drive shaft (not shown) mentioned above. This boss 40 is formed in a cylindrical shape extending toward the other end side in the axial direction, and is configured to be capable of fitting in a center hole 53 provided in the second shroud 50. In an outer circumferential surface of the boss 40, a plurality of first grooves 41 penetrating in the axial direction are formed at equal circumferential intervals. The first groove 41 is formed in a radially outward opened semicircular shape in cross-section. In addition, a bush 42 which is an insert component made of metal is attached to the axis of this boss 40.

The bush (an insert) 42 is made of metal, for example, carbon steel, brass, or the like, and is embedded by insert molding in the boss 40 of the first shroud 20. The bush 42 is formed with a shaft hole 42*a* into which the drive shape (not shown) mentioned above is press-fitted, and is coupled with this drive shaft in such a manner that they can rotate integrally. In addition, on the bush 42, an anti-rotation portion 42*b* having a polygonal shape in cross-section (a hexagonal shape in cross-section in the example shown) having a plurality of corners 42*c* is formed in a bulging manner on its outer circumferential side. This anti-rotation portion 42*b* uses the action of each corner 42*c* to prevent the bush 42 from spinning (freely rotating) relative to the boss 40.

The second shroud 50 is an integrally-molded product made of resin (preferably, a polyphenylene sulfide (PPS) resin). The second shroud 50 is formed in a disk-like shape having substantially the same outer diameter as the first shroud 20. In the second shroud 50, a circular center hole (a center hole for combination) 53 into which the boss 40 of the first shroud 20 is fitted is formed therethrough in the axial direction. In addition, in a front face 51 of the second shroud 50, the elongated grooves 60 extending radially from the center hole 53 are provided in positions matching the respective blades 30. A rear face 52 of this second shroud 50 is abutted against an ultrasonic horn H at the welding time (see FIG. 10).

The elongated groove 60 is opened on the one end side in the axial direction facing the impeller main body 10, and is so formed as to be capable of receiving the distal end of the blade 30. This elongated groove 60 has a groove bottom 61 facing the distal end 31 of the blade 30 in the axial direction, a front inner face (a front inner face in the direction of rotation) 62 continuous with the groove bottom 61 and formed on the front side in the direction of rotation, and a rear inner face (a rear inner face in the direction of rotation) 65 continuous with the groove bottom 61 and formed on the rear side in the direction of rotation.

The front inner face 62 includes a first inner face 62*a*, a second inner face 62*b*, and a third inner face 62*c* in order from the groove bottom 61 side. The first inner face 62*a* is a slope having an inclination of about 2 degrees in a direction away from the rear inner face 65 from the other end side toward the one end side in the axial direction. The third inner face 62*c* is a slope or a vertical face extending substantially parallel to the first inner face 62*a*, and is separated farther from the rear inner face 65 the third inner face 62*c* faces in the direction of rotation than the first inner face 62*a* is. The second inner face 62*b* is a slope connecting the first inner face 62*a* and the third inner face 62*c* and having a slight inclination (a downward inclination) in a direction toward the groove bottom 61 from the third inner face 62*c* side toward the first inner face 62*a* side. A corner (a step in the elongated groove 60) between the first inner face 62*a* and the second inner face 62*b* is configured as a portion (a welding receiving portion 63) that is welded to the welding abutting portion 33 of the blade 30. In addition, the second inner face 62*b* and the third inner face 62*c* form a flash pool (a space in which flash is pooled) 64 together with the second outer face 32*b* of the blade 30 described above (see FIG. 12).

The rear inner face 65 is a slope having an inclination of about 2 degrees in a direction away from the front inner face 62 from the other end side toward the one end side in the axial direction. This rear inner face 65 is formed as a guide face that guides the rear outer face 35 of the blade 30 in frictional contact therewith when the second shroud 50 is welded to the blade 30. The rear inner face 65 is formed with a plurality of triangular prismatic (wedge-like) guide ribs 66 protruding toward the front inner face 62. The guide ribs 66 protrude into the elongated groove 60 (protrude in a direction substantially perpendicular to the direction of insertion of the blade 30), and when the distal end of the blade 30 is inserted into the elongated groove 60, the guide ribs 66 come into contact with the rear outer face 35 of the blade 30 and presses the blade 30 against the front inner face 62 (the welding receiving portion 63). That is, the guide ribs 66 ease the contact between the rear outer face 35 of the blade 30 and the rear inner face 65 of the elongated groove 60 (reduce the area of contact therebetween).

In an inner circumferential surface in the center hole 53 of the second shroud 50, a plurality of second grooves 54 penetrating in the axial direction are formed at equal circumferential intervals. The second groove 54 is formed in a radially inward opened semicircular shape in cross-section. This second groove 54 having a semicircular shape in cross-section is combined with the first groove 41 similarly having a semicircular shape in cross-section to configure a balance hole B having a circular shape in cross-section and penetrating in the axial direction. The balance hole B is arranged in the vicinity of the inlet 23 (nearer to the axis) between the adjacent blades 30, and is continuous with the discharge passage (the outlet 39) for the cooling water formed between these blades 30. This balance hole B communicates with the front and rear faces of the second shroud 50 (the inside and outside of the impeller 1), thereby allowing the cooling water to escape from the rear face 52 side (a high-pressure side) to the front face 51 side (a low-pressure side) of the second shroud 50 to adjust a pressure difference between the inside and outside of the impeller 1 (a pressure difference between the front and rear faces of the second shroud 50).

Figure 10:
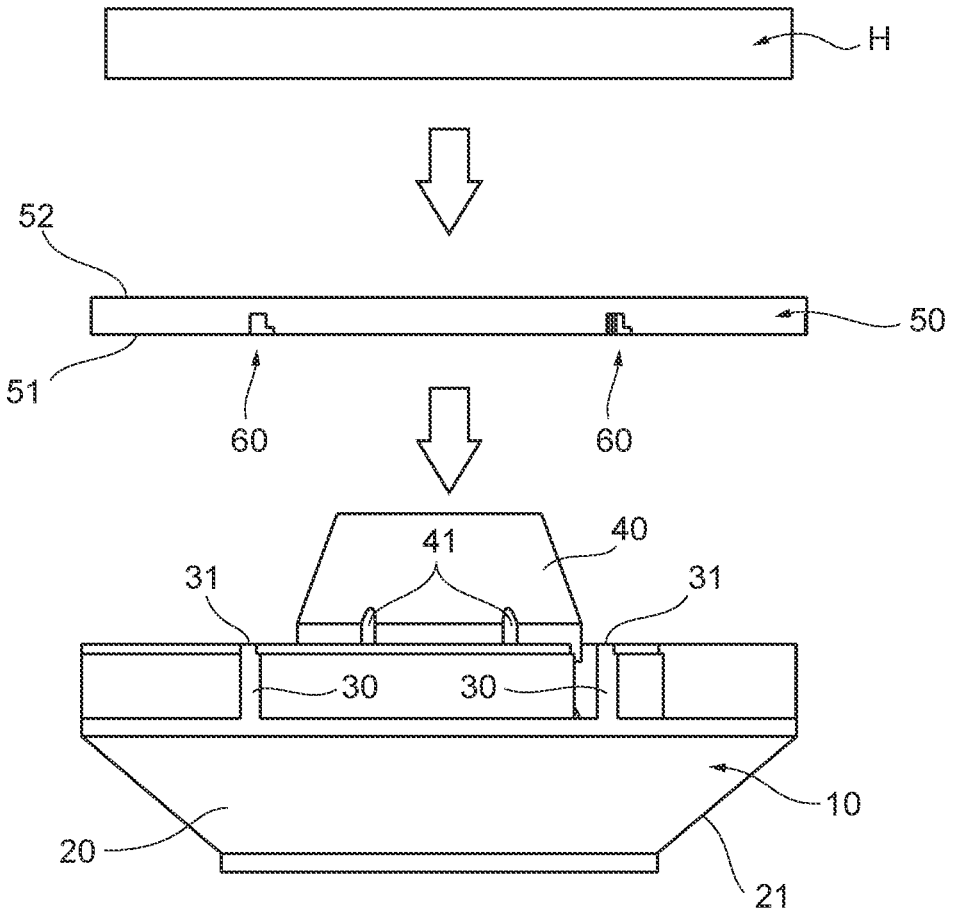
FIG. 10 is a diagram for illustrating a process of welding the impeller.
Figure 11:
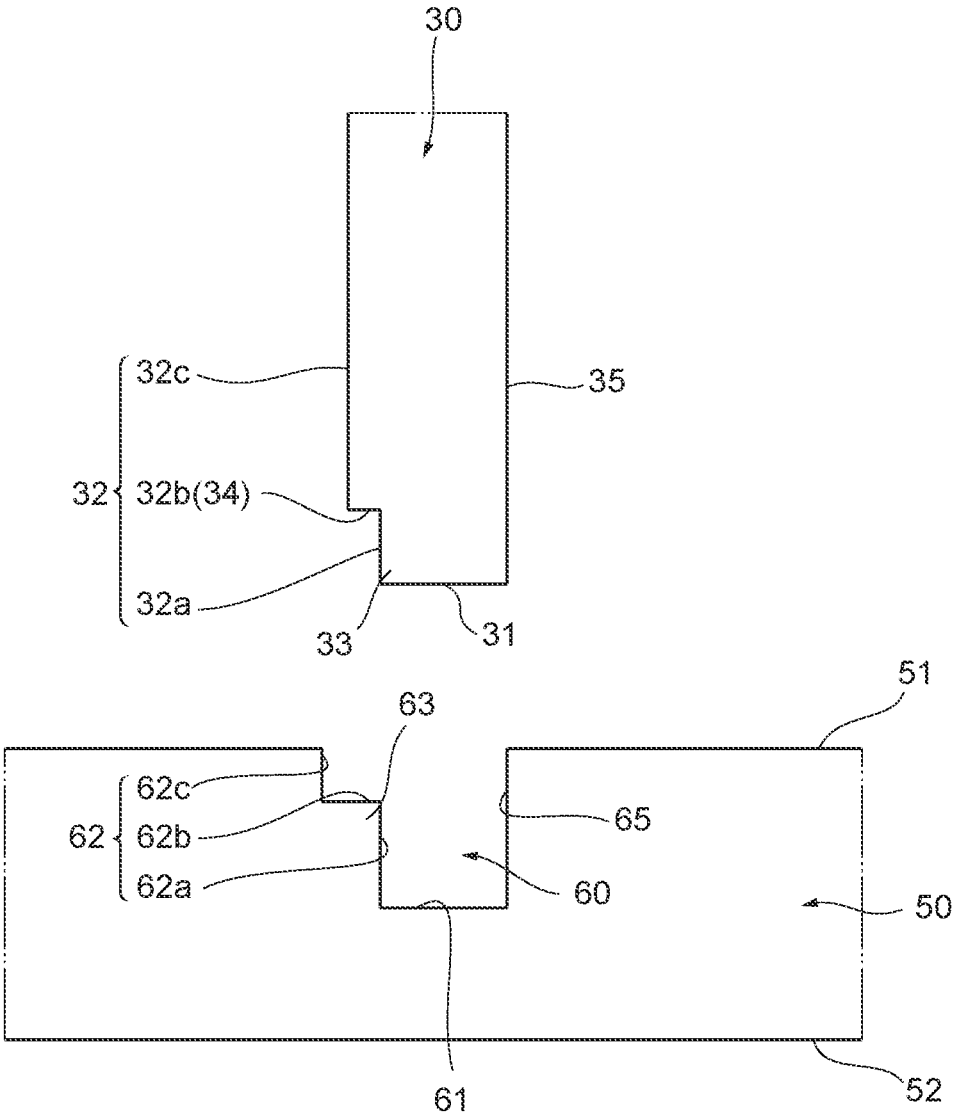
FIG. 11 is a diagram showing a blade of the impeller main body and an elongated groove of the second shroud.
Figure 12:
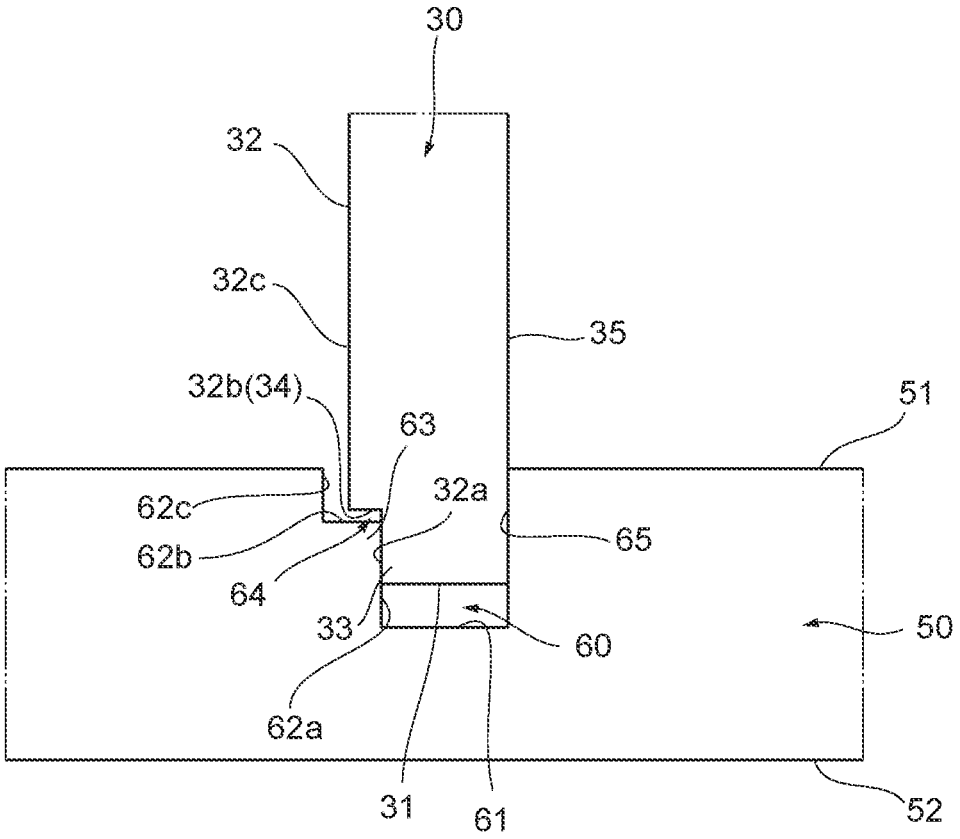
FIG. 12 is a diagram showing a welding abutting portion of the blade and a welding receiving portion of the elongated groove in a welded state.

Next, a method of manufacturing the impeller 1 according to the present embodiment will be described mainly with reference to FIGS. 10 to 12. It should be noted that FIGS. 11 and 12 show the blade 30 and the second shroud 50 in a vertically-inverted positional relation (vertically inverted from the state shown in FIG. 10) in order to facilitate understanding of a welding process.

In the present embodiment, the impeller 1 is manufactured by joining the impeller main body 10 and the second shroud 50, both of which are made of resin, by ultrasonic welding.

In order to manufacture such an impeller 1, first, the impeller main body 10 and the second shroud 50 are separately formed. The impeller main body 10 is injection-molded using a synthetic resin, for example, a polyphenylene sulfide (PPS) resin or the like, as a material. It should be noted that the bush 42 made of metal is insert-molded in the impeller main body 10. Similarly, the second shroud 50 is injection-molded using a synthetic resin, for example, a polyphenylene sulfide (PPS) resin or the like, as a material. It should be noted that both the impeller main body 10 and the second shroud 50 can be molded using an ordinary mold composed of a stationary mold half and a movable mold half without using a core pin or a slide core.

Then, the impeller main body 10 and the second shroud 50 are mounted on a welding jig (not shown). On this welding jig, the impeller main body 10 and the second shroud 50 are mounted in a vertically stacked state in such a manner that the impeller main body 10 is positioned on the lower side and the second shroud 50 is positioned on the upper side. At this time, the distal end of the blade 30 is inserted into the elongated groove 60 of the second shroud 50. In addition, when the impeller main body 10 and the second shroud 50 are in the state of being mounted on the welding jig, the axis of the impeller main body 10 and the axis of the second shroud 50 are aligned with each other, so that their axial directions are vertically oriented.

Then, the ultrasonic horn H of a welder is brought into contact with the rear face of the second shroud 50, and applies pressure and ultrasonic vibration simultaneously to the impeller main body 10 and the second shroud 50 in a vertically stacked state, thereby welding the impeller main body 10 and the second shroud 50. Specifically, the distal end 31 of the blade 30 of the impeller main body 10 is received in the elongated groove 60 of the second shroud 50 with the welding abutting portion 33 of the blade 30 abutted against the welding receiving portion 63 of the elongated groove 60, and in this state, the ultrasonic vibration is applied downward while the pressure is being applied in the same direction.

Here, when the downward pressure is applied to the second shroud 50, the rear outer face 35 of the blade 30 slidingly contacts the rear inner face 65 of the elongated groove 60, so that the rear outer face 35 and the rear inner face 65 act as guide faces when the welding abutting portion 33 is pressed into the welding receiving portion 63. At this time, since the rear inner face 65 is provided with the protruding guide ribs 66, these guide ribs 66 contact the rear outer face 35 and press the blade 30 toward the welding receiving portion 63 (the front inner face 62). Thereby, the front outer face 32 (the welding abutting portion 33) is pressed against the front inner face 62 (the welding receiving portion 63), so that welding of the welding abutting portion 33 and the welding receiving portion 63 is facilitated, and simultaneously, the rear outer face 35 is separated from the rear inner face 65 to reduce the area of contact between the rear outer face 35 of the blade 30 and the rear inner face 65 of the elongated groove 60, so that the amount of flash created by their contact can be reduced. It should be noted that the guide ribs 66 are almost scraped away by the contact (friction) with the rear outer face 35 of the blade 30, and finally become substantially flush with the rear inner face 65. Further, the ultrasonic vibration by the ultrasonic horn H propagates intensively to an interface between the welding abutting portion 33 and the welding receiving portion 63, and frictional heat occurs at the interface therebetween to melt them at the interface, so that the impeller main body 10 and the second shroud 50 are welded.

At this time, the welding abutting portion 33 and the welding receiving portion 63 form a shear joint, and therefore the joining strength between the impeller main body 10 and the second shroud 50 can be improved by securing a wide welding area therebetween. In addition, at the shear joint, only actually melted faces of the welding abutting portion 33 and the welding receiving portion 63 are in contact, and therefore the occurrence of a defect such as a void can be prevented by making air entrapment difficult during welding.

It should be noted that flash created by welding the welding abutting portion 33 and the welding receiving portion 63 is lidded by the second outer face 32*b* (confined in the flash pool 64), thereby being prevented from flowing out of the elongated groove 60. Thereby, an event where flash enters a rotary portion of the impeller 1 and gives an adverse effect to the pump performance is prevented from occurring, and the need for deflashing work in the process of manufacturing the impeller 1 is also eliminated.

Consequently, the impeller main body 10 is joined to the second shroud 50 in this manner, and the impeller 1 is thereby completed. Once the impeller main body 10 and the second shroud 50 are integrated, the first groove 41 of the impeller main body 10 and the second groove 54 of the second shroud 50 are combined, thereby forming a through-hole having a circular shape in cross-section, and this through-hole functions as the balance hole B.

As above, in the impeller 1 according to the present embodiment, since each balance hole B has a split structure in which the first groove 41 formed in the impeller main body 10 and having a semicircular shape in cross-section and the second groove 54 formed in the second shroud 50 and having a semicircular shape in cross-section are combined, thereby configuring the balance hole B having a circular shape in cross-section, the balance hole B can be formed without using a core pin during injection molding, and the possibility of occurrence of a weld line around the balance hole B is also eliminated, so that it becomes possible to prevent an event where a crack staring from the weld line occurs in the impeller 1, resulting in a fracture of the impeller 1.

In addition, in the impeller 1 according to the present embodiment, since the boss 40, which is coupled with the drive shaft of the water pump, is integrally molded into the impeller main body 10, even if there occurs an accidental event where the impeller main body 10 (the blades 30) and the second shroud 50 are disjoined and divided during the operation of the impeller 1, the impeller main body 10 (the blades 30) can rotate integrally with the drive shaft and discharge a predetermined amount of the cooling water, so that it becomes possible to achieve a fail-safe function that prevents an event where feeding the cooling water is completely stopped.

In addition, in the impeller 1 according to the present embodiment, since the protruding guide ribs 66 formed in the elongated groove 60 interfere with the blade 30 and press it when the welding abutting portion 33 and the welding receiving portion 63 are welded, the area of contact between the rear outer face 35 of the blade 30 and the rear inner face

65 of the elongated groove 60 can be reduced, so that it becomes possible to suppress the creation of flash due to their abnormal contact.

It should be noted that the present invention is not limited to the above embodiment, and may be appropriately modified without departing from the spirit of the present invention.

In the above embodiment, a water pump has been given as an example of a fluid pump to describe the present invention, but the present invention is not limited to this configuration, and may be applied to any other fluid pump, for example, a fuel pump, an oil pump, a chemical pump, an air blower pump, or the like.

EXPLANATION OF NUMERALS AND CHARACTERS

1 Impeller
10 Impeller main body
20 First shroud
23 Inlet
30 Blade
31 Distal end
32 Front outer face
33 Welding abutting portion
35 Rear outer face
39 Outlet
40 Boss
41 First groove
42 Bush
50 Second shroud
53 Center hole
54 Second groove
60 Elongated groove
61 Groove bottom
62 Front inner face
63 Welding receiving portion
65 Rear inner face
66 Guide rib
B Balance hole
H Ultrasonic horn
X Direction of rotation

The invention claimed is:

1. A fluid pump impeller rotationally driven around a center axis, comprising an impeller main body including a first shroud and a plurality of blades provided to the first shroud, and a second shroud joined to the impeller main body and so arranged as to face the first shroud in a direction of the center axis with the plurality of blades held therebetween, wherein the first shroud has a boss so formed as to protrude in the direction of the center axis, the second shroud has a center hole into which the boss is inserted in the direction of the center axis, and a recess-like first groove formed in an outer circumferential surface of the boss and a recess-like second groove formed in an inner circumferential surface in the center hole are combined, thereby configuring a balance hole penetrating in the direction of the center axis.

2. The fluid pump impeller according to claim 1, wherein the blades are so formed as to be integrally continuous with an outer circumferential side of the boss, and the first groove is formed between the blades adjacent to each other on the outer circumferential surface of the boss.

3. The fluid pump impeller according to claim 1, wherein the first groove having a semicircular shape in cross-section and the second groove having a semicircular shape in cross-section are combined, thereby configuring the balance hole having a circular shape in cross-section.

4. The fluid pump impeller according to claim 1, wherein the boss is coupled with a drive shaft for rotating the impeller, and the impeller main body is configured to be rotatable integrally with the drive shaft.

5. The fluid pump impeller according to claim 1, wherein the blade has a welding abutting portion at a distal end facing the second shroud in the direction of the center axis, the second shroud has an elongated groove receiving the distal end of the blade, a welding receiving portion abutted against the welding abutting portion and joined thereto is formed on an inner face on one side of the elongated groove, and a protruding guide rib so formed as to protrude into the elongated groove and pressing the blade toward the one side is provided on an inner face on an other side of the elongated groove.

* * * * *